US010282950B2

(12) United States Patent
Soldner et al.

(10) Patent No.: US 10,282,950 B2
(45) Date of Patent: May 7, 2019

(54) DOOR AND WINDOW SENSORS USING AMBIENT INFRARED

(71) Applicant: Carrier Corporation, Farmington, CT (US)

(72) Inventors: Nicholas Charles Soldner, Southbury, CT (US); Sameh Dardona, South Windsor, CT (US); Vijaya Ramaraju Lakamraju, Longmeadow, MA (US); Joseph Zacchio, Wethersfield, CT (US); John Michael Siegler, II, Inver Grove, MN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 15/123,042

(22) PCT Filed: Feb. 11, 2015

(86) PCT No.: PCT/US2015/015344
§ 371 (c)(1),
(2) Date: Sep. 1, 2016

(87) PCT Pub. No.: WO2015/134160
PCT Pub. Date: Sep. 11, 2015

(65) Prior Publication Data

US 2017/0076567 A1 Mar. 16, 2017

Related U.S. Application Data

(60) Provisional application No. 61/949,443, filed on Mar. 7, 2014.

(51) Int. Cl.
*G08B 21/00* (2006.01)
*G08B 13/08* (2006.01)

(52) U.S. Cl.
CPC ..... *G08B 13/08* (2013.01)

(58) Field of Classification Search
CPC ..... G08B 13/08; G08B 13/18
(Continued)

(56) References Cited

U.S. PATENT DOCUMENTS 4,746,910 A * 5/1988 Pfister ..... G08B 13/19 250/340
4,812,810 A * 3/1989 Query ..... F25D 29/008 250/227.22

(Continued)

FOREIGN PATENT DOCUMENTS

AU 2009200531 A1 9/2009
DE 8709734 U1 9/1987

OTHER PUBLICATIONS

PCT International Search Report and Written Opinion dated Apr. 17, 2015, issued on corresponding PCT International Application No. PCT/US2015/015344.

*Primary Examiner* — Mark S Rushing
(74) *Attorney, Agent, or Firm* — Locke Lord LLP; Daniel J. Fiorello; Scott D. Wofsy

(57) ABSTRACT

A sensor assembly for detecting open or closed state in windows and doors includes a passive infrared sensor configured to produce a change in an electrical signal based on a change in infrared radiation incident on the passive infrared sensor. A lens is operatively connected to the passive infrared sensor. At least a portion of the lens is configured to be mounted in an interface between a frame and a door or window mounted to open and close within the frame. The lens is configured to guide ambient infrared radiation to the passive infrared sensor at a first level when the door or window is closed and at a second level when the door or window is open or ajar.

10 Claims, 3 Drawing Sheets

(58) Field of Classification Search
USPC ..... 340/545.3
See application file for complete search history.

(56) References Cited

U.S. PATENT DOCUMENTS

| | | | | |
|---|---|---|---|---|
| 5,729,019 | A * | 3/1998 | Krafthefer | G01J 1/02 250/349 |
| 2006/0187034 | A1* | 8/2006 | Styers | G05B 9/02 340/545.1 |
| 2008/0030328 | A1* | 2/2008 | Sharma | G08B 13/08 340/552 |
| 2009/0015405 | A1* | 1/2009 | DiPoala | G08B 13/08 340/556 |
| 2010/0283394 | A1* | 11/2010 | Ong | G01J 1/04 315/158 |
| 2012/0127317 | A1* | 5/2012 | Yantek | G01V 8/14 348/156 |
| 2012/0268274 | A1* | 10/2012 | Wieser | G08B 13/08 340/545.2 |
| 2013/0057404 | A1 | 3/2013 | Thibault | |

* cited by examiner

DOOR AND WINDOW SENSORS USING AMBIENT INFRARED

RELATED APPLICATIONS

This application is a U.S. National Stage Application of PCT/US2015/015344 filed Feb. 11, 2015, which claims the benefit of and priority to U.S. Provisional Patent Application No. 61/949,443 filed Mar. 7, 2014, the contents of which are incorporated herein by reference in their entirety.

BACKGROUND OF THE INVENTION

1. Field of the Invention

The present disclosure relates to sensors, and more particularly to sensors for detecting whether doors, windows, and the like are closed or ajar, for example in security systems.

2. Description of Related Art

Many traditional sensors for detecting intrusion through a door or window, for example, rely on magnetic sensors. One magnetic sensor component is attached to the door or window, for example, and a corresponding sensor component is attached to the respective door or window frame. When the two components are close together, as when the door or window is closed, the magnetic field of one sensor component can be registered by the other, indicating the door or window is secure. When the door or window is opened, the magnetic field of the one sensor component is no longer registered by the other, indicating a possible intrusion.

Such conventional methods and systems have generally been considered satisfactory for their intended purpose. However, there is still a need in the art for improved sensors for detecting whether doors, windows, and the like are secure. The present disclosure provides a solution for this need.

SUMMARY OF THE INVENTION

A sensor assembly for detecting open or closed state in windows and doors includes a passive infrared sensor configured to produce a change in an electrical signal based on a change in infrared radiation incident on the passive infrared sensor. A lens is operatively connected to the passive infrared sensor. At least a portion of the lens is configured to be mounted in an interface between a frame and a door or window mounted to open and close within the frame. The lens is configured to guide ambient infrared radiation to the passive infrared sensor at a first level when the door or window is closed and at a second level when the door or window is open or ajar.

In certain embodiments, the lens is configured to receive ambient infrared radiation incident thereon from a first direction, and to direct infrared radiation onto the passive infrared sensor in a second direction different from the first direction. For example, the first and second directions can be about 90° apart.

It is contemplated that the lens can include a first portion housing the passive infrared sensor and includes an ambient window configured to face an ambient environment. The lens can also that includes a second portion angled relative to the first portion, wherein the second portion is configured to be mounted in the interface between a frame and a door or window mounted to open and close within the frame. The first and second portions of the lens can be operatively connected to one another to direct ambient infrared radiation incident on the ambient window of the first portion, into the second portion, and through the second portion to the passive infrared sensor in the first portion. The second portion of the lens can include an interface window configured to be in the interface between a frame and a door or window, wherein the interface window is configured to alter how much infrared radiation is incident on the passive infrared sensor depending on whether the door or window is closed. It is contemplated that at least the second portion of the lens can have a thickness less than about 2 mm.

The lens can include an adhesive surface configured for mounting the lens with at least a portion of the lens in the interface between a frame and a door or window mounted to open and close within the frame. The lens can include an acrylic material, or any other suitable material. The passive infrared sensor can be a first passive infrared sensor, and a second infrared sensor can be operatively connected to the lens, wherein the second infrared sensor is oriented in a direction to receive a level of ambient infrared radiation independent of whether the door or window is closed for adjustment of the first passive infrared sensor to account for changes in ambient infrared levels. It is also contemplated that a capacitive sensor can be operatively connected to the lens to detect a change in capacitance based on whether the door or window is closed to provide an additional modality of detection.

In another aspect, a security sensor assembly for detecting open or closed state in windows and doors includes a single piece passive non-magnetic sensor configured to produce a change in an electrical signal based on open or closed state of a door or window. The single piece passive non-magnetic sensor can be configured to be unaffected by long term changes in geometry of the door or window of greater than one inch in magnitude. The single piece passive non-magnetic sensor can include an adhesive surface configured for mounting to at least one of a door frame, a door, a window frame, a window, or the like.

A method of detecting the state of a door or window includes receiving ambient infrared radiation with a passive infrared sensor at a first level when a door or window is in a closed state. The method also includes receiving ambient infrared radiation with the passive infrared sensor at a second level different from the first level when the door or window is open or ajar.

In accordance with certain embodiments, receiving ambient infrared radiation with a passive infrared sensor at a first level when a door or window is in a closed state includes guiding a first level of ambient infrared radiation through a lens to the passive infrared sensor. Receiving ambient infrared radiation with the passive infrared sensor at a second level different from the first level when the door or window is open or ajar can include guiding a second level of ambient infrared radiation through the lens to the passive infrared sensor.

At least a portion of the lens can be positioned in an interface between a frame and the door or window when the door or window is closed. Guiding a first level of ambient infrared radiation through a lens to the passive infrared sensor can include allowing a first level of loss of ambient infrared radiation from the lens due to the door or window being closed, and guiding a second level of ambient infrared radiation through a lens to the passive infrared sensor can include allowing a second level of loss of ambient infrared radiation from the lens due to the door or window being open or ajar. The lens can receive ambient infrared radiation incident thereon from a first direction, and can direct infrared radiation onto the passive infrared sensor in a second direction different from the first direction.

In another aspect, the passive infrared sensor is a first passive infrared sensor and the method can include receiving a level of ambient radiation with a second passive infrared sensor oriented in a direction to receive a level of ambient radiation independent of whether the door or window is closed. The method can include adjusting the first passive infrared sensor to account for changes in ambient infrared levels. It is also contemplated that the method can include detecting whether the door or window is closed using a capacitive sensor to provide an additional modality of detection.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
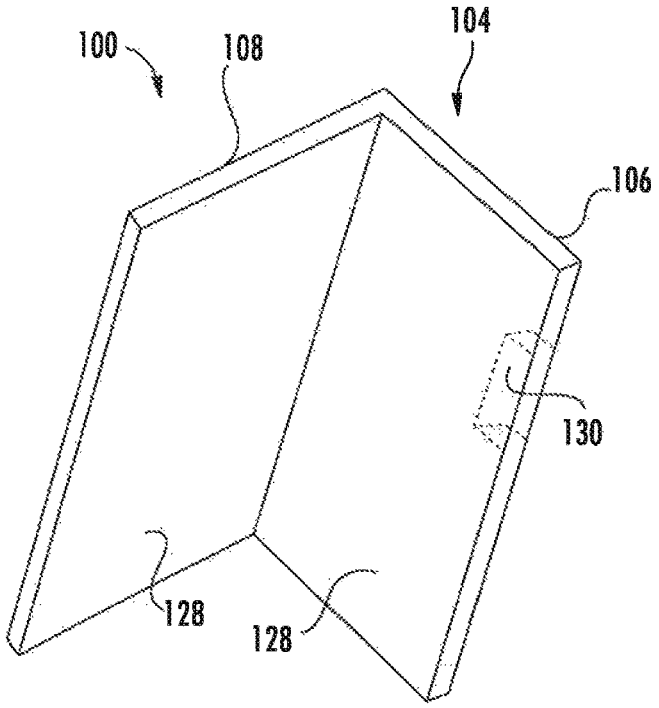
FIG. 1 is a perspective view of an exemplary embodiment of a sensor assembly constructed in accordance with the present disclosure, showing the lens from within.

Reference will now be made to the drawings wherein like reference numerals identify similar structural features or aspects of the subject disclosure. For purposes of explanation and illustration, and not limitation, a partial view of an exemplary embodiment of a sensor assembly in accordance with the disclosure is shown in FIG. 1 and is designated generally by reference character 100. Other embodiments of sensor assemblies in accordance with the disclosure, or aspects thereof, are provided in FIGS. 2-5, as will be described. The systems and methods described herein can be used for detection of whether doors, windows, or the like, are secure.

Figure 2:
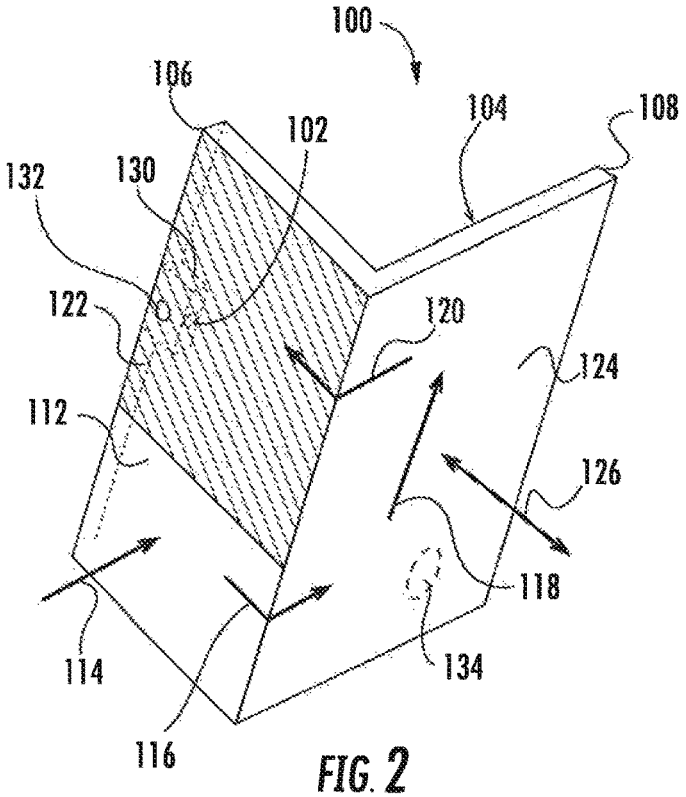
FIG. 2 is a perspective view of the sensor assembly of FIG. 1, showing the lens from the opposite side of that shown in FIG. 1, and schematically indicating the pathways of ambient radiation into the passive infrared sensor.

Sensor assembly 100 shown in FIG. 1 is configured for detecting open or closed state in windows, doors, and the like. Sensor assembly 100 includes a passive infrared sensor 102, identified in FIG. 2, which is configured to produce a change in an electrical signal based on a change in infrared radiation incident on the passive infrared sensor 102. A lens 104 is operatively connected to the passive infrared sensor 102. Lens 104 includes two portions, namely a first lens portion 106 housing passive infrared sensor 102, and a second lens portion 108 that is configured to be mounted in an interface 140 (identified in FIG. 4) between a frame and a door or window mounted to open and close within the frame, as will be further described below. Lens 104 defines an L-shaped cross-section as shown in FIGS. 1 and 2, wherein second lens portion 108 is angled 90° relative to the first lens portion 106. Lens 104 can include an adhesive surface 128 for mounting lens 104 to a door, window, or frame for a door or window. For example, the entire inner surface of first and second lens portions 106 and 108 can be covered with an adhesive, as indicated in FIG. 1, or only a portion of that inner surface can include the adhesive. Any other suitable method for affixing lens 104 can also be used without departing from the scope of this disclosure.

With reference now to FIG. 2, lens 104 is configured to guide ambient infrared radiation to the passive infrared sensor 102 at a first level when the door or window is closed and at a second level when the door or window is open or ajar. Lens portion 106 houses the passive infrared sensor 102 and includes an ambient window 112 configured to face an ambient environment. Lens 104 is configured to receive ambient infrared radiation incident thereon from a first direction, and to direct infrared radiation onto the passive infrared sensor 102 in a second direction different from the first direction. The first and second lens portions 106 and 108 are operatively connected to one another to direct ambient infrared radiation, represented by arrow 114 in FIG. 2, incident on the ambient window 112, into the second lens portion 108 as indicated by arrow 116, through the second lens portion 108 as indicated by arrow 118, back into the first lens portion 106 as indicated by arrow 120, and to the passive infrared sensor 102 in the first lens portion 106. In this example, the direction, e.g., arrow 114, at which ambient radiation is received at lens 104 is different by 90° from the direction, e.g., arrow 120, at which the radiation is received at passive infrared sensor 102. However those skilled in the art will readily appreciate that any other suitable directions or angles can be used without departing from the scope of this disclosure. A shield or pattern inscribed in lens 104 between window 112 and the upper half of lens portion 106 can block radiation from passing directly from window 112 to sensor 102.

Lens 104 includes an acrylic material, and the optical connection between first and second lens portions 106 and 108 can be by means of both being formed integrally of a single acrylic part. It is also contemplated that the first and second lens portions 106 and 108 can be formed separately of acrylic and then joined by any suitable means that allows optical communication of ambient radiation from one lens portion to the other. Any other suitable materials can be used for lens 104. Lens 104 serves as a wave guide to convey ambient infrared radiation to passive infrared sensor 102. It is to be understood that sensor assembly 100 and its components are not necessarily drawn to scale in FIGS. 1-5. The first and second lens portions 106 and 108 are dimensioned to be effective waveguides, and second portion 108 is dimensioned to occupy the space between a door or window and its frame without interfering with operation of the door or window. For example, it is contemplated that the second lens portion 108 can have a thickness less than about 2 mm.

The first lens portion 106 includes a shielding layer 122 that blocks ambient radiation from reaching passive infrared sensor 102 directly without passing through second lens portion 108. The second lens portion 108 includes an interface window 124 configured to be in and face into the interface 140 (identified in FIG. 4) between a frame and a door or window, e.g., to face in the direction from the door frame to the door when the door is closed. Interface window 124 is configured to alter how much infrared radiation is incident on the passive infrared sensor 102 depending on whether the door or window is closed. Arrow 126 in FIG. 2 indicates radiation losses or gains that change depending on the open or closed state of the door or window, which change corresponds to a change in the infrared radiation input at passive infrared sensor 102 dependent on the open or closed state of the door or window.

Lens 104 can be used to amplify sensitivity to infrared radiation received at passive infrared sensor 102 by focusing infrared radiation onto a smaller area of the surface to be detected. For example interface window 124 and/or ambient window 112 can include a convex lens, diffraction grating, Fresnel lens, or the like to provide the focusing. This can be accomplished, for example, by scoring the surface of interface window 124 and/or ambient window 112 to form a Fresnel lens or diffraction grating.

As shown in FIG. 2, passive infrared sensor 102 is housed in a sensor unit 130 and is oriented to receive infrared radiation from the direction of second lens portion 108. A second infrared sensor 132 can optionally be housed in sensor unit 130 or in any other suitable location, e.g. facing outward through shielding layer 122, to have a view of the ambient environment. This makes the second passive infrared sensor 132 operative to receive a level of ambient infrared radiation that is unaffected by or independent of whether the door or window is closed. This information can be used for adjustment of the first passive infrared sensor 102, or the signal therefrom, to account for changes in ambient infrared levels that should not trigger an alarm, for example. It is also contemplated that an optional capacitive sensor 134 can be operatively connected to lens 104 and sensor unit 130 to detect a change in capacitance based on whether the door or window is closed to provide an additional modality of detection of door or window state.

Figure 3:
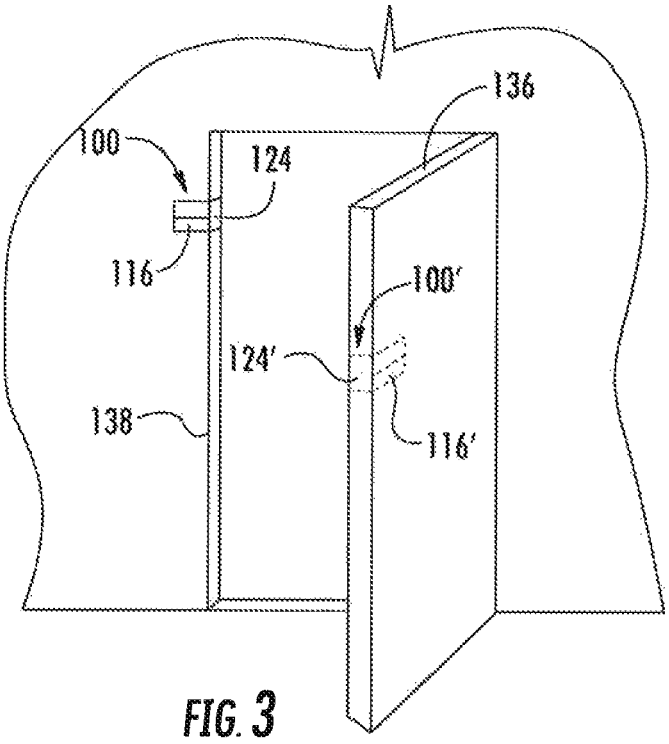
FIG. 3 is a schematic perspective view of a door frame with the sensor assembly of FIG. 1 mounted thereto, showing the orientation of the two portions of the lens relative to the door and door frame.

Referring now to FIG. 3, sensor assembly 100 can be used as a security sensor for detecting open or closed state in windows and doors, using a single piece passive non-magnetic sensor configured to produce a change in an electrical signal based on open or closed state of a door or window as already described. This is in contrast to magnetic security systems that use two separate pieces, one affixed to a door or window, and the other affixed to the frame of the door or window. Since sensor assembly 100 only uses a single piece passive non-magnetic sensor, it is configured to be unaffected by long term changes in geometry of the door or window. For example, sensor assembly 100 can tolerate changes in geometry over time of greater than one inch in magnitude, whereas typical two-piece magnetic sensors can be rendered inoperative by such changes over time.

Figure 4:
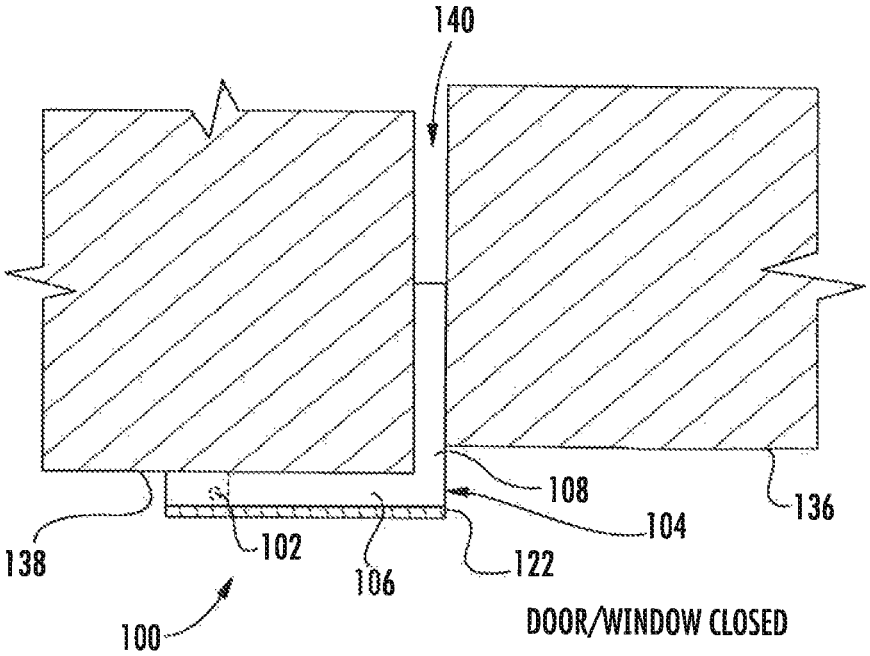
FIG. 4 is a cross-sectional plan view of the sensor assembly of FIG. 1, showing the lens mounted to the door frame with a portion of the lens between the door and the doorframe with the door closed.

As shown in FIG. 3, the single piece passive non-magnetic sensor assembly 100 can be mounted to a door frame with the ambient window 116 faced outward toward ambient conditions, e.g., toward the exterior conditions or interior conditions of a room, and with interface window 124 facing inward into the interface 140 (identified in FIG. 4) between door 136 and door frame 138 when door 136 is in the closed position. Another exemplary position for a sensor assembly 100' is shown in dashed lines in FIG. 3, namely on door 136, with ambient window 116' facing toward ambient and with interface window 124' arranged to face into the interface 140 (identified in FIG. 4) between the door 136 and frame 138 when the door 136 is in the closed position. As shown in FIG. 4, second lens portion 108 is positioned in an interface 140 between a frame 138 and the door 136 the door is closed. Those skilled in the art will readily appreciate that sensor assemblies in accordance with this disclosure can affixed to a door, a door frame, a window, a window frame, or any other suitable place.

Figure 5:
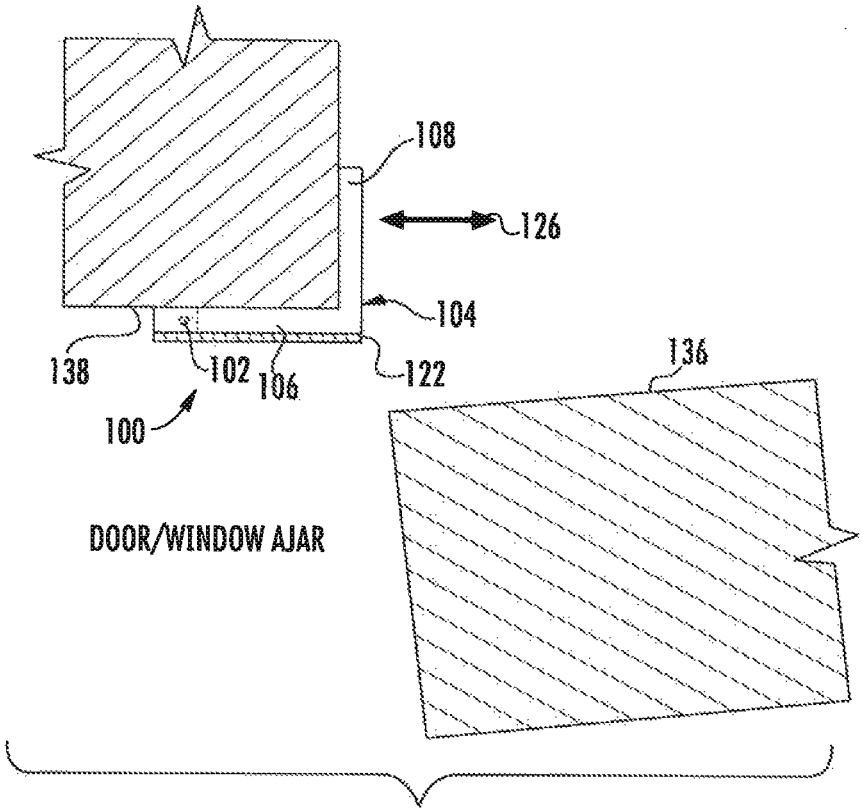
FIG. 5 is a cross-sectional plan view of the sensor assembly of FIG. 1, showing the lens mounted to the door frame with the door ajar.

Referring now to FIGS. 4 and 5, a method of detecting the state of a door or window is described. The method includes receiving ambient infrared radiation with a passive infrared sensor 102 at a first level when a door 136 is in a closed state as shown in FIG. 4. The method also includes receiving ambient infrared radiation with the passive infrared sensor 102 at a second level different from the first level when the door 136 is ajar or open, as shown in FIG. 3. This change in ambient infrared radiation reaching passive infrared sensor 102 is due to different levels in losses or gains in infrared radiation guided to passive infrared sensor 102 when door 136 is open, as indicated by arrow 126 in FIGS. 2 and 5, which are different from the levels of loss or gain when door 136 is closed as shown in FIG. 4.

Thus when a door or window is in a closed state, sensor assembly 100 guides a first level of ambient infrared radiation through lens 104 to the passive infrared sensor 102. When the door or window is ajar or open, sensor assembly 100 guides a second level of ambient infrared radiation through lens 104 to the passive infrared sensor 102. Passive infrared sensor 102 can therefore impart a change on an electrical signal based on whether the door is closed or not, and the change in signal can be used to monitor the door, e.g., for security or alarm purposes.

The method can include receiving a level of ambient radiation with a second passive infrared sensor 132 oriented in a direction to receive a level of ambient radiation independent of and unaffected by whether the door or window is closed, e.g., passive infrared sensor 132 sees through an aperture in shielding layer 122 and is oriented to directly detect ambient radiation from the direction indicated by arrow 114 in FIG. 2. The method can therefore include adjusting the first passive infrared sensor 102, or the signal therefrom, to account for changes in ambient infrared levels. For example, if there is a certain change in the ambient infrared environment, but the door 136 has not changed from being closed, an alarm will not sound if the reading from the second passive infrared sensor 132 is used as described above.

Sensor unit 130, shown in FIG. 2, is operatively connected to passive infrared sensor 102 and optional second passive infrared and capacitive sensors 132 and 134. Those skilled in the art will readily appreciate that sensor unit 130 can include any suitable components to support the sensor function described above. For example, sensor unit 130 can include a power source for powering the sensors, control logic for determining the state of the door or window, and an antenna for wirelessly transmitting data regarding the state of the door or window to a central security system.

In one example, a 1 μA passive infrared sensor can be used, e.g., as passive infrared sensor 102. With or without the second passive infrared sensor 132, an initial calibration can be used to initialize the sensitivity. An advantage of using passive infrared sensors is that no excitation, such as from a near infrared light emitting diode (NIR LED), is required. However, it is contemplated that active infrared functionality could optionally be added if suitable for certain applications. Only one device needs to be affixed, e.g., to the door or frame, to be able to sense the state of a door or window, rather than two devices as in active infrared or magnetic sensor systems. Those skilled in the art will readily appreciate that motion detection can be optionally added to sensors in accordance with this disclosure, and that sensors as described above can potentially be mounted where traditional sensors cannot, giving potential benefits of flexibility in installation compared to traditional systems.

While described above in the exemplary context of sensing the open, closed, and/or ajar state of doors that hinge open and closed, any other suitable applications including windows and any type of door or opening is contemplated. Moreover, those skilled in the art will readily appreciate that systems and methods as described herein can readily be applied to doors, windows, and the like that slide, roll, or move in any other suitable manner without departing from the scope of this disclosure. Besides doors and windows, the methods and apparatus described herein can be used in any other suitable moving interface. For example, a sensor assembly as described above can be mounted in the interface between any two suitable surfaces that move relative to one another, e.g., moving between a first and second position, to detect the movement.

Additionally, while described in the exemplary context of detecting whether a door closed versus open or ajar, those skilled in the art will readily appreciate that the systems and methods described herein can also be used to detect movement of the door or window, for example if the door or window starts ajar and then moves. It is also contemplated that the systems and methods described herein can be used to detect if a door or window is completely open because of the amplitude difference that can be detected due to the lack of interaction between the door or window edge and the sensor.

The methods and systems of the present disclosure, as described above and shown in the drawings, provide for sensors for detecting whether windows, doors, or the like, are closed. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A sensor assembly for detecting open or closed state in windows and doors comprising:

a passive infrared sensor configured to produce a change in an electrical signal based on a change in infrared radiation incident on the passive infrared sensor; and a lens operatively connected to the passive infrared sensor, wherein at least a portion of the lens is configured to be mounted in an interface between a frame and a door or window mounted to open and close within the frame, and wherein at least a portion of the lens is a waveguide that is configured to guide ambient infrared radiation to the passive infrared sensor at a first level when the door or window is closed and at a second level when the door or window is ajar, wherein the lens includes:

a first portion housing the passive infrared sensor and including an ambient window configured to face an ambient environment; and a second portion angled relative to the first portion, wherein the second portion is configured to be mounted in the interface between a frame and a door or window mounted to open and close within the frame, wherein the first and second portions of the lens are operatively connected to one another to direct ambient infrared radiation incident on the ambient window of the first portion, into the second portion, through the second portion to the passive infrared sensor in the first portion.

2. The sensor assembly of claim 1, wherein the lens is configured to receive ambient infrared radiation incident thereon from a first direction, and to direct infrared radiation onto the passive infrared sensor in a second direction different from the first direction.

3. The sensor assembly of claim 2, wherein the first and second directions are about 90° apart.

4. The sensor assembly of claim 1, wherein the second portion of the lens includes an interface window configured to face into the interface between a frame and a door or window, wherein the interface window is configured to alter how much infrared radiation is incident on the passive infrared sensor depending on whether the door or window is ajar.

5. The sensor assembly of claim 1, wherein at least the second portion of the lens has a thickness less than about 2 mm.

6. The sensor assembly of claim 1, wherein the lens includes an adhesive surface configured for mounting the lens with at least a portion of the lens in the interface between a frame and a door or window mounted to open and close within the frame.

7. The sensor assembly of claim 1, wherein the lens includes an acrylic material.

8. The sensor assembly of claim 1, further comprising a capacitive sensor operatively connected to the lens to detect a change in capacitance based on whether the door or window is ajar to provide an additional modality of detection.

9. The sensor assembly of claim 1, wherein the passive infrared sensor is a first passive infrared sensor, and further comprising a second infrared sensor operatively connected to the lens, wherein the second infrared sensor is oriented in a direction to receive a level of ambient infrared radiation independent of whether the door or window is ajar for adjustment of the first passive infrared sensor to account for changes in ambient infrared levels.

10. A sensor assembly for detecting state of an interface between two surfaces:

a passive infrared sensor configured to produce a change in an electrical signal based on a change in infrared radiation incident on the passive infrared sensor; and a lens operatively connected to the passive infrared sensor, wherein at least a portion of the lens is configured to be mounted in an interface between a first surface and a second surface movable relative to the first surface, and wherein the lens is a waveguide that is configured to guide ambient infrared radiation to the passive infrared sensor at a first level when the first surface is in a first position relative to the second surface and at a second level when the first surface is in a second position relative to the second surface, wherein the lens includes:

a first portion housing the passive infrared sensor and including an ambient window configured to face an ambient environment; and a second portion angled relative to the first portion, wherein the second portion is configured to be mounted in the interface between a frame and a door or window mounted to open and close within the frame, wherein the first and second portions of the lens are operatively connected to one another to direct ambient infrared radiation incident on the ambient window of the first portion, into the second portion, through the second portion to the passive infrared sensor in the first portion.

* * * * *